US006890157B2

(12) United States Patent
Pfeil et al.

(10) Patent No.: US 6,890,157 B2
(45) Date of Patent: May 10, 2005

(54) MATCHING OR NOT MATCHING FLOW RATES IN TWO FLUIDLY-UNCONNECTED FLOW PATHS

(75) Inventors: Michael C. Pfeil, Dayton, OH (US); Gary C. Fulks, Spring Valley, OH (US)

(73) Assignee: Delphi Technologies, Inc., Troy, MI (US)

( * ) Notice: Subject to any disclaimer, the term of this patent is extended or adjusted under 35 U.S.C. 154(b) by 43 days.

(21) Appl. No.: 10/358,463

(22) Filed: Feb. 5, 2003

(65) Prior Publication Data

US 2004/0151596 A1 Aug. 5, 2004

(51) Int. Cl.[7] ..... B01D 61/32; F04B 41/06

(52) U.S. Cl. ..... 417/53; 417/426; 210/646; 604/6.11

(58) Field of Search ..... 417/42, 43, 44.2, 417/53, 426, 427, 42.6; 210/87, 101, 646, 739, 741; 604/4.01, 6.11, 19, 890.1; 73/1.31, 1.35, 1.48, 168, 195, 196, 861.18

(56) References Cited

U.S. PATENT DOCUMENTS 5,111,683 A * 5/1992 Fond ..... 73/1.27
5,727,933 A * 3/1998 Laskaris et al. ..... 418/2
6,481,452 B2 11/2002 Reuter et al.
6,689,083 B1 * 2/2004 Gelfand et al. ..... 604/5.04
6,691,047 B1 * 2/2004 Fredericks ..... 702/47

* cited by examiner

*Primary Examiner*—Charles G. Freay
(74) *Attorney, Agent, or Firm*—Michael D. Smith

(57) ABSTRACT

A flow rate of unconnected first and second fluid flows is matched or not matched, such as, but not limited to, matching or not matching the flow rate of the replacement water stream with the waste water stream in kidney dialysis. First and second flow paths are interconnected so substantially the same flow from a first positive displacement pump in the first path encounters a flow-rate transducer in the second path. A first set of transducer readings are taken for various values of the controllable first pump speed of the first pump. The first and second flow paths are disconnected, and a second set of transducer readings are taken for various values of the controllable second pump speed of the second pump. The flow rates are substantially matched or not matching by controlling one of the first and second pump speeds using the other of the pump speeds and the first and second sets of readings.

20 Claims, 4 Drawing Sheets

MATCHING OR NOT MATCHING FLOW RATES IN TWO FLUIDLY-UNCONNECTED FLOW PATHS

TECHNICAL FIELD

The present invention relates generally to fluid flow, and more particularly to a method and to a system for matching or not matching the fluid flow rates in two fluidly-unconnected flow paths.

BACKGROUND OF THE INVENTION

Certain procedures require the matching or not matching of two fluid flow rates. Some conventional flow rate matching systems use a finely calibrated positive displacement pump (e.g., a peristaltic pump) in the first flow path and use a finely calibrated flow rate transducer in the second flow path. To match the flow rates, the pump speed of the finely calibrated (i.e., calibrated pump flow rate versus pump speed) positive displacement pump is controlled by using a pump speed corresponding to the calibrated pump flow rate which matches the flow rate reading of the finely calibrated flow rate transducer, as is understood by those skilled in the art.

What is needed is an improved method for matching or not matching first and second flow rates and an improved fluid flow-rate matching or non-matching system useful, for example, in performing kidney dialysis.

SUMMARY OF THE INVENTION

A first method of the invention is for matching or not matching first and second flow rates of respective first and second fluid flows in respective, fluidly-unconnected first and second flow paths, wherein the first flow path includes a first positive displacement pump having a controllable first pump speed which controls the first flow rate, and wherein the second flow path includes a second positive displacement pump having a controllable second pump speed which controls the second flow rate and includes a flow-rate transducer downstream of the second positive displacement pump. The first method includes steps a) through g). Step a) includes shutting off the second positive displacement pump. Step b) includes fluidly interconnecting the first and second flow paths creating an interconnected flow path which allows substantially the same flow from the first positive displacement pump to encounter the flow-rate transducer. Step c) includes, after steps a) and b), obtaining a first set of readings from the flow-rate transducer for various values of the first pump speed. Step d) includes disconnecting the fluid interconnection between the first and second flow paths. Step e) includes turning on the second positive displacement pump. Step f) includes, after steps d) and e), obtaining a second set of readings from the flow-rate transducer for various values of the second pump speed. Step g) includes substantially matching or not matching the first and second flow rates by controlling one of the first and second pump speeds using the other of the first and second pump speeds and the first and second sets of readings. It is noted that two flow rates are not matched when one flow rate is less than or is greater than the other flow rate.

A first embodiment of the invention is a system for matching or not matching first and second flow rates of respective first and second fluid flows and includes first and second fluid flow paths, a fluid interconnection conduit, and first and second sets of readings. The first fluid flow path contains the first fluid flow, includes a first positive displacement pump having a controllable first pump speed which controls the first flow rate, and includes a first valve downstream of the first positive displacement pump. The second fluid flow path contains the second fluid flow, includes a second positive displacement pump having a controllable second pump speed which controls the second flow rate, and includes a flow-rate transducer downstream of the second positive displacement pump. The fluid interconnection conduit has a first end, a second end, and an interconnection valve between the first and second ends. The first end is in fluid communication with the first fluid flow path between the first valve and the first positive displacement pump. The second end is in fluid communication with the second fluid flow path between the second positive displacement pump and the flow-rate transducer. The first set of readings is a first set of readings from the flow-rate transducer for various values of the first pump speed taken with the second positive displacement pump shut off, the interconnection valve open, and the first valve shut. The second set of readings is a second set of readings from the flow-rate transducer for various values of the second pump speed taken with the second positive displacement pump turned on and the interconnection valve shut. The first and second flow rates are substantially matched or not matched by controlling one of the first and second pump speeds using the other of the first and second pump speeds and the first and second sets of readings with the interconnection valve shut and the first valve open.

Several benefits and advantages are derived from one or more of the method and the embodiment of the invention. Using a first positive displacement pump in the first flow path and a second positive displacement pump in the second flow path allows matching or non-matching of the flow rates in the first and second flow paths independent of a primary flow rate of a primary flow path when the first flow path is a fill line (such as the replacement water stream) and the second flow path is a drain line (such as the waste water stream) of the primary flow path (such as in a kidney dialysis machine). Using uncalibrated positive displacement pumps and an uncalibrated flow-rate transducer reduces costs over using calibrated equipment.

DESCRIPTION OF THE PREFERRED EMBODIMENT

Figure 1:
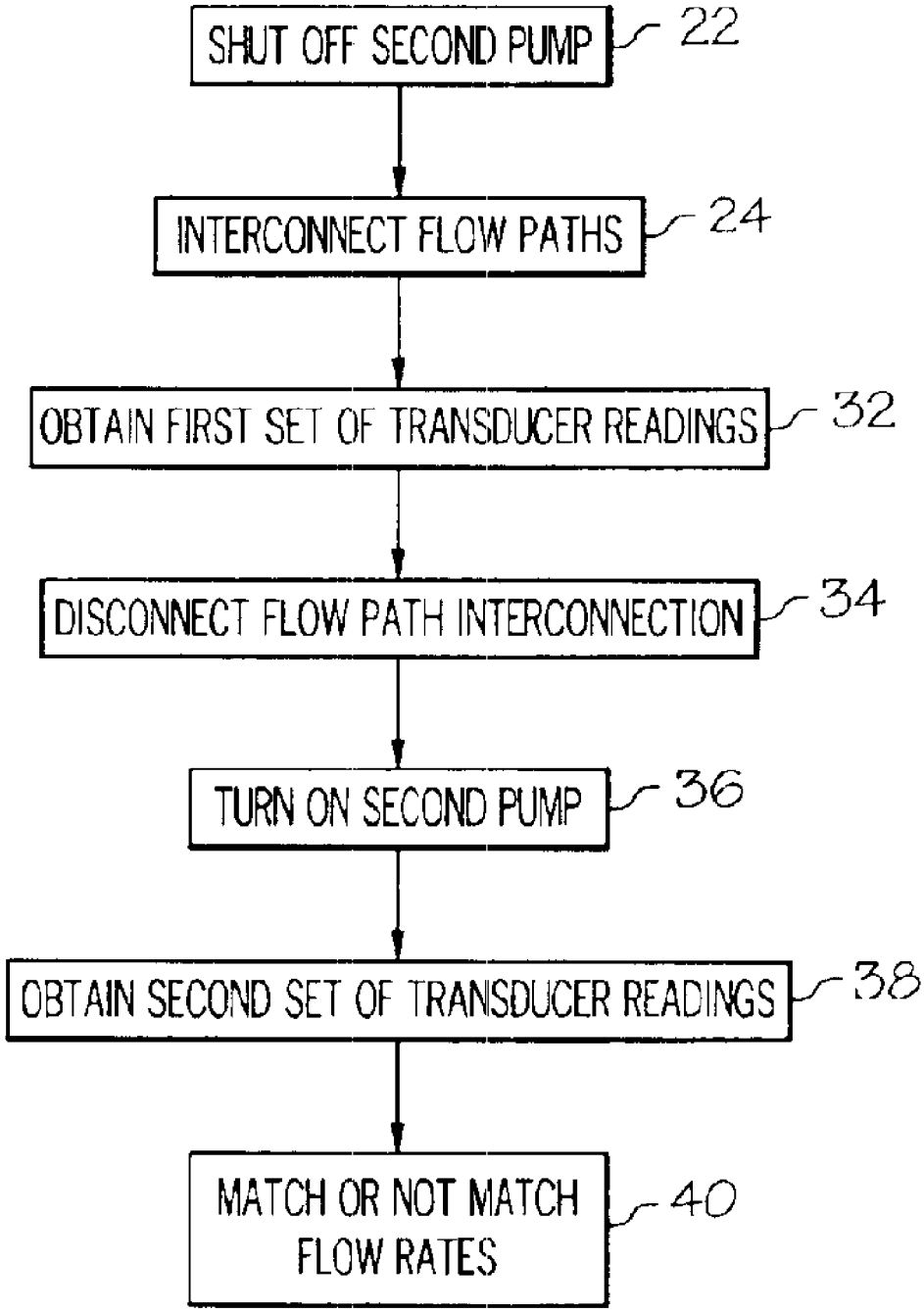
FIG. 1 is a flow chart of a first method for matching or not matching first and second fluid flow rates in respective, fluidly-unconnected first and second flow paths.
Figure 2:
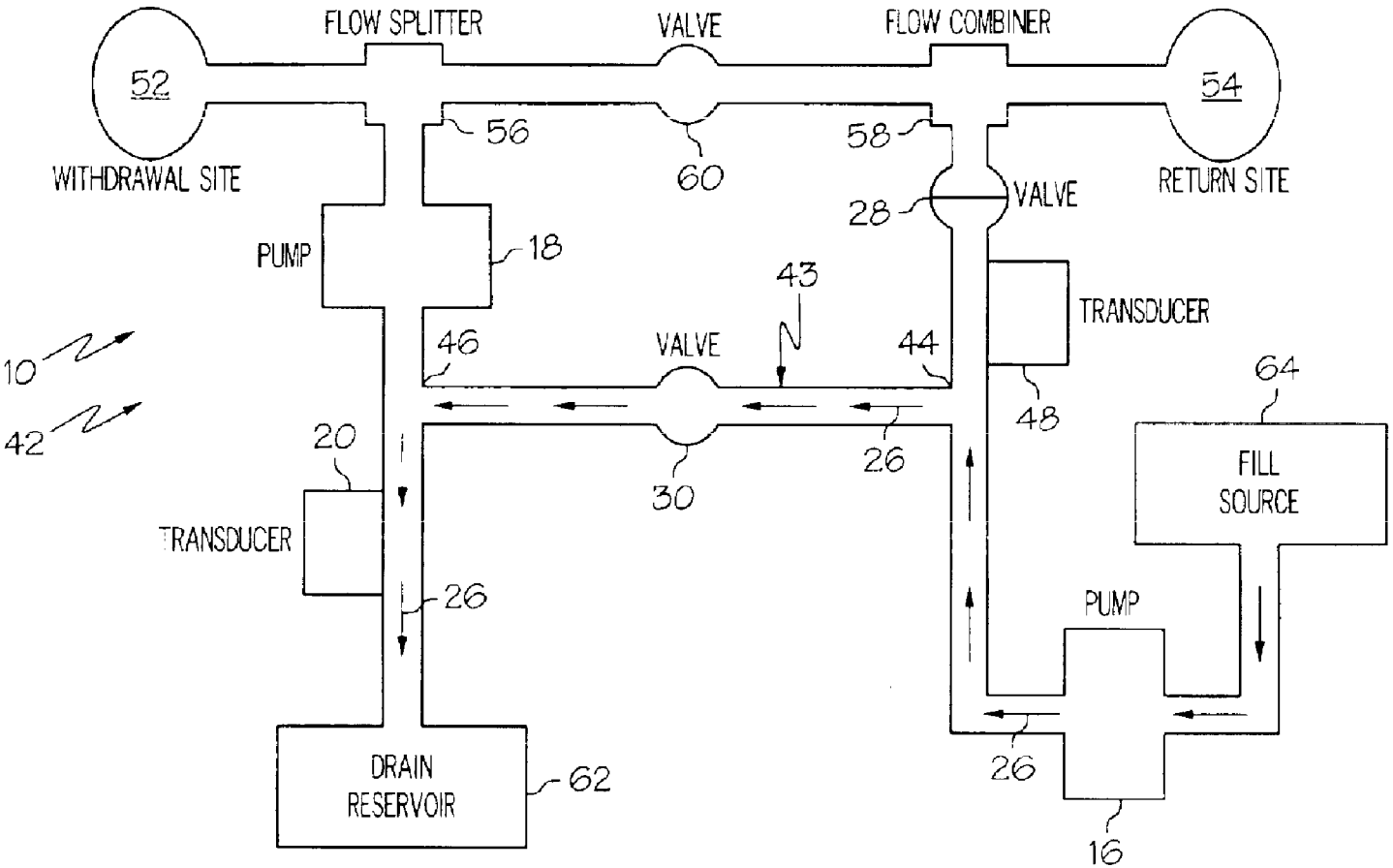
FIG. 2 is a schematic diagram of a first embodiment of a system for carrying out the first method of FIG. 1 shown in a first pump calibration mode wherein the flow paths are interconnected and the second pump is shut off to obtain transducer readings for the first pump for various values of the first pump speed.
Figure 3:
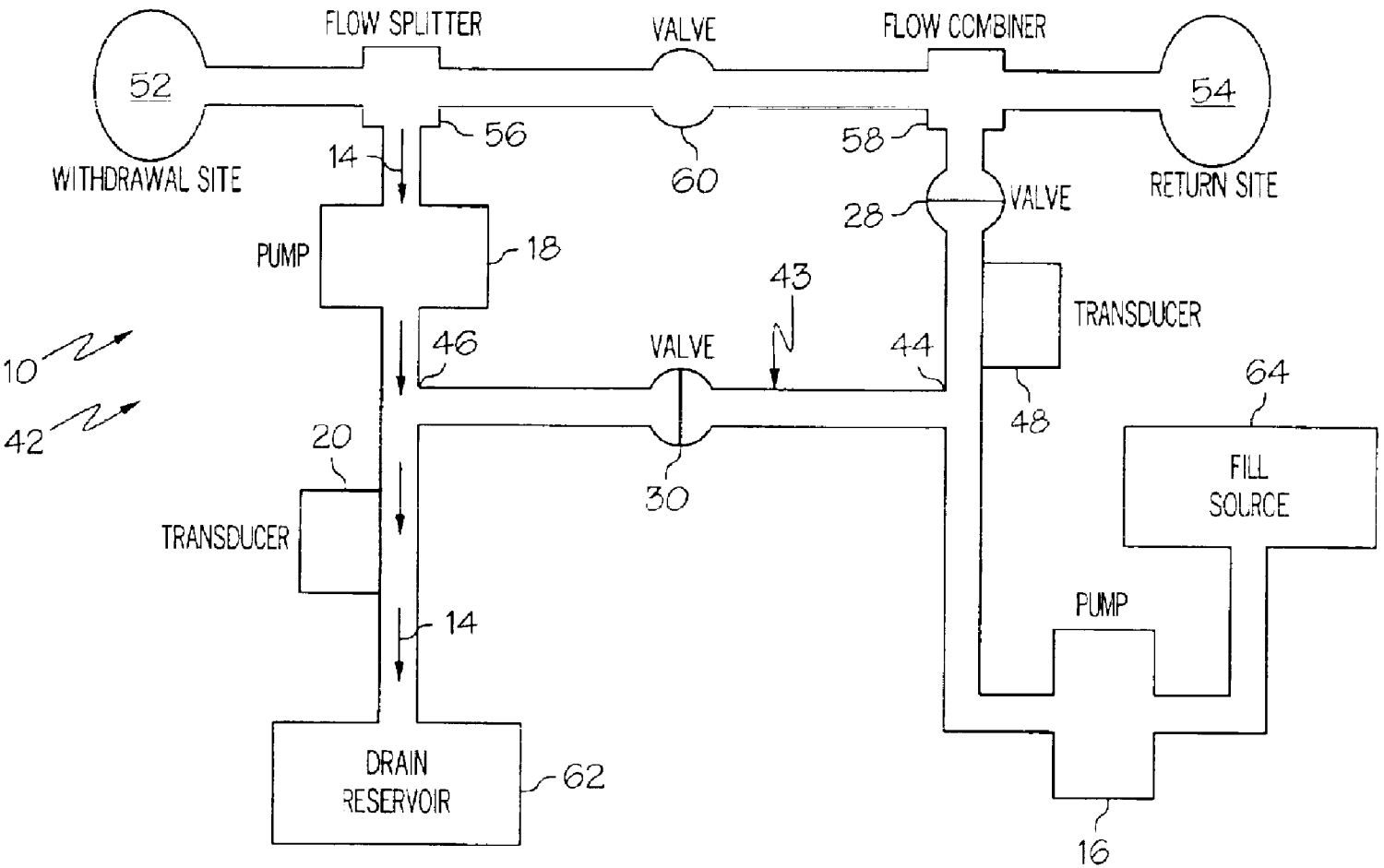
FIG. 3 is a view as in FIG. 2 but with the system shown in a second pump calibration mode wherein the flow paths are disconnected and the second pump is turned on to obtain transducer readings for the second pump for various values of the second pump speed.
Figure 4:
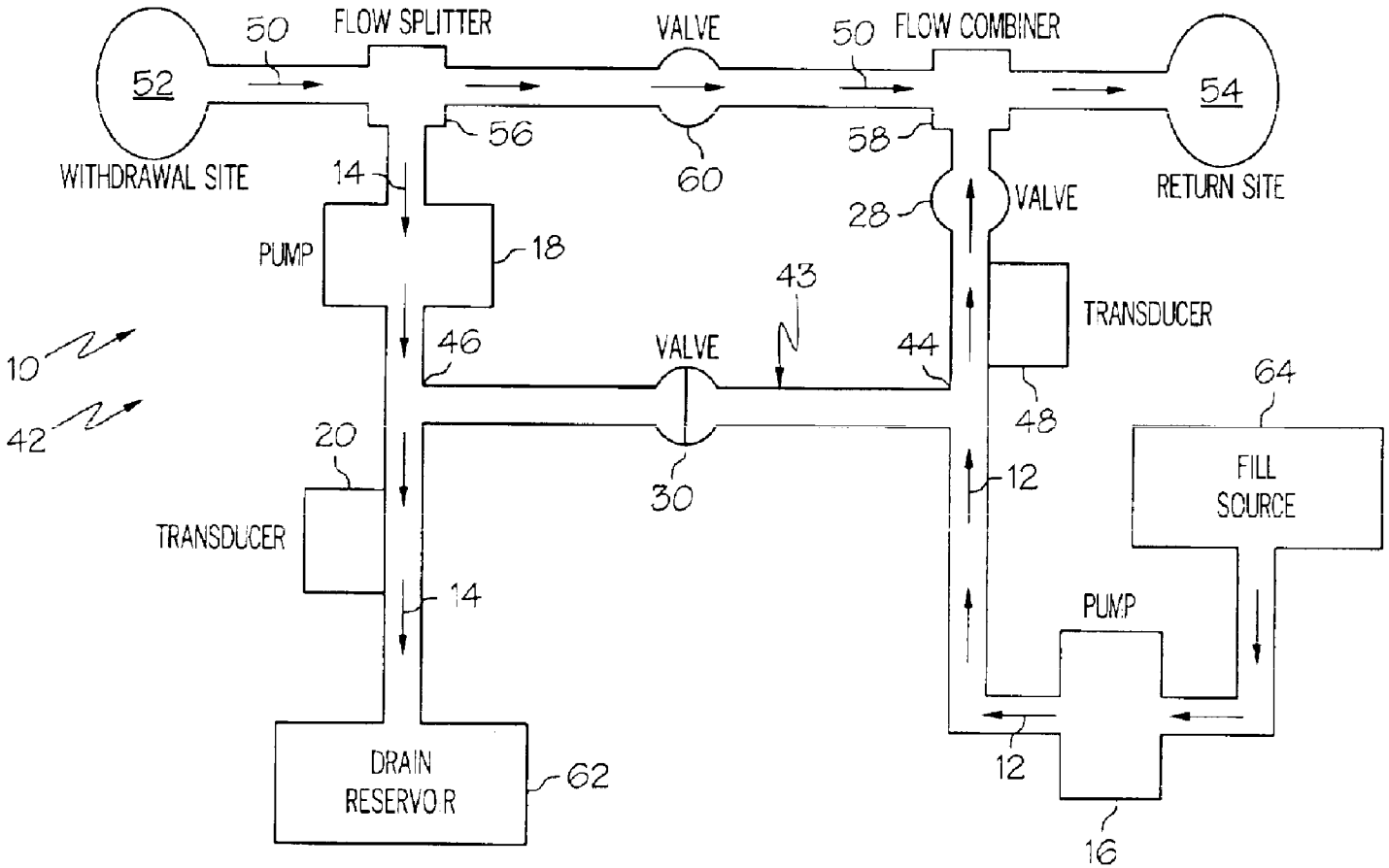
FIG. 4 is a view as in FIG. 3 but with the system shown in a normal operating mode.

Referring now to the drawings, wherein like numerals represent like elements throughout, FIG. 1 shows a first method of the invention, and FIGS. 2–4 show a first embodiment of a system 10 for carrying out the first method. The first method is for matching or not matching first and second flow rates of respective first and second fluid flows in respective, fluidly-unconnected first and second flow paths 12 and 14 (shown by flow arrows in FIG. 4), wherein the first flow path 12 includes a first positive displacement pump 16 having a controllable first pump speed which controls the first flow rate, and wherein the second flow path 14 includes a second positive displacement pump 18 having a controllable second pump speed which controls the second flow rate and includes a flow-rate transducer 20 downstream of the second positive displacement pump 18. The first method includes steps a) through g).

Step a) is labeled as "Shut Off Second Pump" in block 22 of FIG. 1. Step a) includes shutting off the second positive displacement pump 18.

Step b) is labeled as "Interconnect Flow Paths" in block 24 of FIG. 1. Step b) includes fluidly interconnecting the first and second flow paths creating an interconnected flow path 26 (shown by flow arrows in FIG. 2) which allows substantially the same flow from the first positive displacement pump 16 to encounter the flow-rate transducer 20. In one implementation of step b), as shown in FIG. 2, the first valve 28 is shut and the interconnection valve 30 is open.

Step c) is labeled as "Obtain First Set Of Transducer Readings" in block 32 of FIG. 1. Step c) includes, after steps a) and b), obtaining a first set of readings from the flow-rate transducer 20 for various values of the first pump speed. In one example, the value of the first pump speed is the value of the pump speed setting (which in one variation is the pump speed control signal) of the first positive displacement pump 16, as can be appreciated by the artisan. In one implementation of step c), the first pump speed of the first positive displacement pump 16 in FIG. 2 is incrementally changed, by incrementally changing the pump speed setting (such as in one variation changing the pump speed control signal), to create the various values of the first pump speed, and the flow is allowed to reach steady state before the transducer readings are taken. Other implementations of step c) are left to the artisan. In one application of the first method, step c) includes storing the various values of the first pump speed of the first positive displacement pump 16 and the corresponding transducer readings of the flow-rate transducer 20 in a map file (also known as a lookup table) in a computer (not shown) with the computer generating the various values of the first pump speed and with the flow-rate transducer 20 sending its reading to the computer through a signal path (not shown). In one variation, the map file is a two column file, wherein the first column is the various values of the first pump speed, wherein the second column is the readings of the flow-rate transducer 20, and wherein the flow-rate transducer reading in a row is the corresponding transducer reading which corresponds to the value of the first pump speed in the same row of the map file. In one example, the computer incrementally changes the first pump speed of the first positive displacement pump 16 through another signal path (not shown). Other implementations of step c) are left to the artisan.

Step d) is labeled as "Disconnect Flow Path Interconnection" in block 34 of FIG. 1. Step d) includes disconnecting the fluid interconnection between the first and second flow paths. In one implementation of step d), as shown in FIG. 3, the first valve 28 is shut and the interconnection valve 30 is shut.

Step e) is labeled as "Turn On Second Pump" in block 36 of FIG. 1. Step e) includes turning on the second positive displacement pump 18.

Step f) is labeled as "Obtain Second Set Of Transducer Readings" in block 38 of FIG. 1. Step f) includes, after steps d) and e), obtaining a second set of readings from the flow-rate transducer 20 for various values of the second pump speed. The discussion of the examples, implementations, etc. for obtaining the first set of transducer readings in step c) is equally applicable to obtaining the second set of transducer readings in step f), as can be appreciated by the artisan.

Step g) is labeled as "Match Or Not Match Flow Rates" in block 40 of FIG. 1. Step g) includes substantially matching the first and second flow rates by controlling one of the first and second pump speeds using the other of the first and second pump speeds and the first and second sets of readings. In one implementation of step g), as shown in FIG. 4, the first valve 28 is open and the interconnection valve 30 is shut. It is noted that step c) and f) values and readings are understood to include interpolated and/or extrapolated values and readings. In one implementation of step g), the computer uses the present value of the first pump speed (such as the present first pump speed setting such as the present first pump speed control signal) as a reference, looks up the flow rate corresponding to the present first pump speed value from the first set of readings, looks up the second pump speed value corresponding to that flow rate from the second set of readings, and uses that second pump speed value as the present value of the second pump speed (such as the present second pump speed setting such as the present second pump speed control signal). In one variation, a nominal second pump speed value equal to the present first pump speed value is modified to achieve the present second pump speed. In another implementation, the computer generates a combined map file of pairs of first and second pump speed values for various flow rates wherein the first and second pump speed values of any pair correspond to the same flow rate, and wherein the computer looks up the present first pump speed value in the combined map file and uses the corresponding paired second pump speed value as the present second pump speed. Other implementations of step g) are left to the artisan.

In one example of the first method, the flow-rate transducer 20 is an uncalibrated flow-rate transducer. It is noted that a flow-rate transducer measures the flow rate of a fluid flow if it directly or indirectly measures the flow rate. In one variation, the flow-rate transducer 20 is an uncalibrated differential pressure transducer. Other examples of flow-rate transducers are left to the artisan. In the same or another example, each of the first and second positive displacement pumps 16 and 18 is an uncalibrated positive displacement pump. In one variation, each of the first and second positive displacement pumps 16 and 18 is an uncalibrated peristaltic pump. Other examples of positive displacement pumps are left to the artisan. In one application of the first method, the first flow path 12 is a replacement water (such as a saline solution) flow path of a kidney dialysis machine 42, and the second flow path 14 is a waste water flow path of the kidney dialysis machine 42. Typically, the flow rates in a kidney dialysis machine are not matched such that the flow rate of the replacement water (such as a saline solution) is less than the flow rate of the waste water. Other applications are left to the artisan.

A first embodiment of the invention is a system 10 for matching or not matching first and second flow rates of respective first and second fluid flows and includes first and second fluid flow paths 12 and 14 (shown by flow arrows in FIG. 4), a fluid interconnection conduit 43, and first and second sets of readings. The first fluid flow path 12 contains the first fluid flow, includes a first positive displacement pump 16 having a controllable first pump speed which controls the first flow rate, and includes a first valve 28 downstream of the first positive displacement pump 16. The second fluid flow path 14 contains the second fluid flow, includes a second positive displacement pump 18 having a controllable second pump speed which controls the second flow rate, and includes a flow-rate transducer 20 downstream of the second positive displacement pump 18. The fluid interconnection conduit 43 has a first end 44, a second end 46, and an interconnection valve 30 between the first and second ends 44 and 46. The first end 44 is in fluid communication with the first fluid flow path 12 between the first valve 28 and the first positive displacement pump 16. The second end 46 is in fluid communication with the second fluid flow path 14 between the second positive displacement pump 18 and the flow-rate transducer 20. The first set of readings is a first set of readings from the flow-rate transducer 20 for various values of the first pump speed taken with the second positive displacement pump 18 shut off, the interconnection valve 30 open, and the first valve 28 shut. The second set of readings is a second set of readings from the flow-rate transducer 20 for various values of the second pump speed taken with the second positive displacement pump 18 turned on and the interconnection valve 30 shut. The first and second flow rates are substantially matched or not matching by controlling one of the first and second pump speeds using the other of the first and second pump speeds and the first and second sets of readings with the interconnection valve shut 30 and the first valve 28 open. The previously-described implementations, examples, etc. of the first method are equally applicable to the system 10, as can be appreciated by the artisan.

In one example of the kidney dialysis machine 42, the first flow path 12 also includes an additional flow rate transducer 48 used for fault detection in the first flow path 12 (such as for detecting an inoperative first positive displacement pump 16 in FIG. 4). The kidney dialysis machine 42 additionally includes a primary flow path 50 (shown by flow arrows in FIG. 4) from a blood withdrawal site 52 of the patient (not shown) to a blood return site 54 of the patient. The primary flow path 50 also includes an upstream flow splitter 56, a downstream flow combiner 58, and an intervening valve 60. The flow splitter 56 filters waste water from the withdrawn blood making the waste water available as the second fluid flow for the second flow path 14. The second flow path 14 ends in a drain reservoir 62. The primary flow path 50 contains a thickened blood stream between the flow splitter 56 and the flow combiner 58. The flow combiner 58 receives and combines the first fluid flow (water/saline replacement) of the first flow path 12 and the thickened blood stream for blood return to the patient. The first flow path 12 receives its water/saline replacement from a fill source 64. The first and second pump speeds are controlled independent of the pressure (flow rate) in the primary flow path 50.

As can be appreciated by those skilled in the art, the kidney dialysis method and system application is more broadly expressed by describing the method and system 10 of FIGS. 1–4 as a method for partially draining and refilling any primary fluid flow and a system 10 for partially draining and refilling any primary fluid flow. Here, the second flow path 14 is in fluid communication with the partial drain site (e.g., 56) of the primary flow path 50 and the first flow path 12 is in fluid communication with the refill site (e.g., 58) of the primary flow path 50. Examples of such broadened application are left to the artisan.

Several benefits and advantages are derived from one or more of the method and the embodiment of the invention. Using a first positive displacement pump in the first flow path and a second positive displacement pump in the second flow path allows matching or non-matching of the flow rates in the first and second flow paths independent of a primary flow rate of a primary flow path when the first flow path is a fill line (such as the replacement water stream) and the second flow path is a drain line (such as the waste water stream) of the primary flow path (such as in a kidney dialysis machine). Using uncalibrated positive displacement pumps and an uncalibrated flow-rate transducer reduces costs over using calibrated equipment.

The foregoing description of a method and an embodiment of the invention has been presented for purposes of illustration. It is not intended to be exhaustive or to limit the invention to the precise form or procedure disclosed, and obviously many modifications and variations are possible in light of the above teaching. It is intended that the scope of the invention be defined by the claims appended hereto.

What is claimed is:

1. A method for matching or not matching first and second flow rates of respective first and second fluid flows in respective, fluidly-unconnected first and second flow paths, wherein the first flow path includes a first positive displacement pump having a controllable first pump speed which controls the first flow rate, wherein the second flow path includes a second positive displacement pump having a controllable second pump speed which controls the second flow rate and includes a flow-rate transducer downstream of the second positive displacement pump, and wherein the method comprises the steps of:

a) shutting off the second positive displacement pump;

b) fluidly interconnecting the first and second flow paths creating an interconnected flow path which allows substantially all of a flow of fluid from the first positive displacement pump to encounter the flow-rate transducer;

c) after steps a) and b), obtaining a first set of readings from the flow-rate transducer for various values of the first pump speed;

d) disconnecting the fluid interconnection between the first and second flow paths;

e) turning on the second positive displacement pump;

f) after steps d) and e), obtaining a second set of readings from the flow-rate transducer for various values of the second pump speed; and g) substantially matching or not matching the first and second flow rates by controlling one of the first and second pump speeds using the other of the first and second pump speeds and the first and second sets of readings.

2. The method of claim 1, wherein the flow-rate transducer is an uncalibrated flow-rate transducer.

3. The method of claim 2, wherein the flow-rate transducer is an uncalibrated differential pressure transducer.

4. The method of claim 1, wherein each of the first and second positive displacement pumps is an uncalibrated positive displacement pump.

5. The method of claim 4, wherein each of the first and second positive displacement pumps is an uncalibrated peristaltic pump.

6. The method of claim 4, wherein the flow-rate transducer is an uncalibrated flow-rate transducer.

7. The method of claim 6, wherein the flow-rate transducer is an uncalibrated differential pressure transducer.

8. The method of claim 7, wherein each of the first and second positive displacement pumps is an uncalibrated peristaltic pump.

9. The method of claim 8, wherein the first flow path is a water replacement flow path of a kidney dialysis machine, and wherein the second flow path is a waste water flow path of the kidney dialysis machine.

10. The method of claim 1, wherein the first flow path is a water replacement flow path of a kidney dialysis machine, and wherein the second flow path is a waste water flow path of the kidney dialysis machine.

11. A system for matching or not matching first and second flow rates of respective first and second fluid flows comprising:

a) a first fluid flow path containing the first fluid flow, including a first positive displacement pump having a controllable first pump speed which controls the first flow rate, and including a first valve downstream of the first positive displacement pump;

b) a second fluid flow path containing the second fluid flow, including a second positive displacement pump having a controllable second pump speed which controls the second flow rate, and including a flow-rate transducer downstream of the second positive displacement pump;

c) a fluid interconnection conduit having a first end, a second end, and an interconnection valve between the first and second ends, wherein the first end is in fluid communication with the first fluid flow path between the first valve and the first positive displacement pump, and wherein the second end is in fluid communication with the second fluid flow path between the second positive displacement pump and the flow-rate transducer;

d) a first set of readings from the flow-rate transducer for various values of the first pump speed taken with the second positive displacement pump shut off, the interconnection valve open, and the first valve shut; and e) a second set of readings from the flow-rate transducer for various values of the second pump speed taken with the second positive displacement pump turned on and the interconnection valve shut, wherein the first and second flow rates are substantially matched or not-matched by controlling one of the first and second pump speeds using the other of the first and second pump speeds and the first and second sets of readings with the interconnection valve shut and the first valve open.

12. The system of claim 11, wherein the flow-rate transducer is an uncalibrated flow-rate transducer.

13. The system of claim 12, wherein the flow-rate transducer is an uncalibrated differential pressure transducer.

14. The system of claim 11, wherein each of the first and second positive displacement pumps is an uncalibrated positive displacement pump.

15. The system of claim 14, wherein each of the first and second positive displacement pumps is an uncalibrated peristaltic pump.

16. The system of claim 14, wherein the flow-rate transducer is an uncalibrated flow-rate transducer.

17. The system of claim 16, wherein the flow-rate transducer is an uncalibrated differential pressure transducer.

18. The system of claim 17, wherein each of the first and second positive displacement pumps is an uncalibrated peristaltic pump.

19. The system of claim 18, wherein the first flow path is a water replacement flow path of a kidney dialysis machine, and wherein the second flow path is a waste water flow path of the kidney dialysis machine.

20. The system of claim 11, wherein the first flow path is a water replacement flow path of a kidney dialysis machine, and wherein the second flow path is a waste water flow path of the kidney dialysis machine.

* * * * *